US011873814B2

(12) United States Patent
Beierlein et al.

(10) Patent No.: US 11,873,814 B2
(45) Date of Patent: Jan. 16, 2024

(54) ROTARY SLIDE ASSEMBLY, AND METHOD FOR MONITORING THE WEAR OF A SLIDE IN A ROTARY SLIDE ASSEMBLY

(71) Applicant: Gebr. Becker GmbH, Wuppertal (DE)

(72) Inventors: Stefan Beierlein, Leichlingen (DE); Sven Hilfert, Wuppertal (DE)

(73) Assignee: Gebr. Becker GmbH, Wuppertal (DE)

( * ) Notice: Subject to any disclaimer, the term of this patent is extended or adjusted under 35 U.S.C. 154(b) by 129 days.

(21) Appl. No.: 17/624,388

(22) PCT Filed: Jul. 1, 2020

(86) PCT No.: PCT/EP2020/068518
§ 371 (c)(1),
(2) Date: Jan. 3, 2022

(87) PCT Pub. No.: WO2021/001421
PCT Pub. Date: Jan. 7, 2021

(65) Prior Publication Data

US 2022/0356880 A1 Nov. 10, 2022

(30) Foreign Application Priority Data

Jul. 4, 2019 (DE) ..... 10 2019 118 139.9

(51) Int. Cl.
*F04C 18/344* (2006.01)
*F04C 28/28* (2006.01)
*F04C 25/02* (2006.01)

(52) U.S. Cl.
CPC ..... *F04C 18/3441* (2013.01); *F04C 28/28* (2013.01); *F04C 25/02* (2013.01);
(Continued)

(58) Field of Classification Search
CPC ..... F04C 2/32–46; F04C 18/32–46; F04C 2270/16–165; F04C 2270/17–175; F01C 1/32–46
See application file for complete search history.

(56) References Cited

U.S. PATENT DOCUMENTS 3,301,194 A 1/1967 Brunson
6,565,337 B2 5/2003 Henderson
(Continued)

FOREIGN PATENT DOCUMENTS

DE 40 35 463 A1 5/1992
DE 103 30 541 A1 2/2005
FR 2 985 553 A1 7/2013

OTHER PUBLICATIONS

International Search Report of PCT/EP2020/068518, dated Oct. 16, 2020.

*Primary Examiner* — Laert Dounis
(74) *Attorney, Agent, or Firm* — Collard & Roe, P.C.

(57) ABSTRACT

The invention relates to a rotary slide assembly and to a method for monitoring the wear of one or more slides in a rotary slide assembly, comprising a rotary slide rotor and one or more slide receiving areas for the slide(s) in the rotary slide rotor. The wear state of the one or more slides is detected during the operation or during a standstill of the rotary slide assembly. For this purpose, the slide(s) or one or more corresponding slide receiving areas in interaction with the one or more slides are used to generate or request an electric or electronic signal.

13 Claims, 11 Drawing Sheets

(52) U.S. Cl.
CPC .... *F04C 2240/81* (2013.01); *F04C 2270/165* (2013.01); *F04C 2270/80* (2013.01)

(56) References Cited

U.S. PATENT DOCUMENTS

| | | | | |
|---|---|---|---|---|
| 6,877,966 | B2 | 4/2005 | Henderson | |
| 2003/0202895 | A1* | 10/2003 | Althouse | F01C 21/0809 418/2 |
| 2004/0136852 | A1 | 7/2004 | Hedrick et al. | |
| 2015/0345492 | A1* | 12/2015 | Ahmeti | F04C 15/0023 418/229 |

* cited by examiner

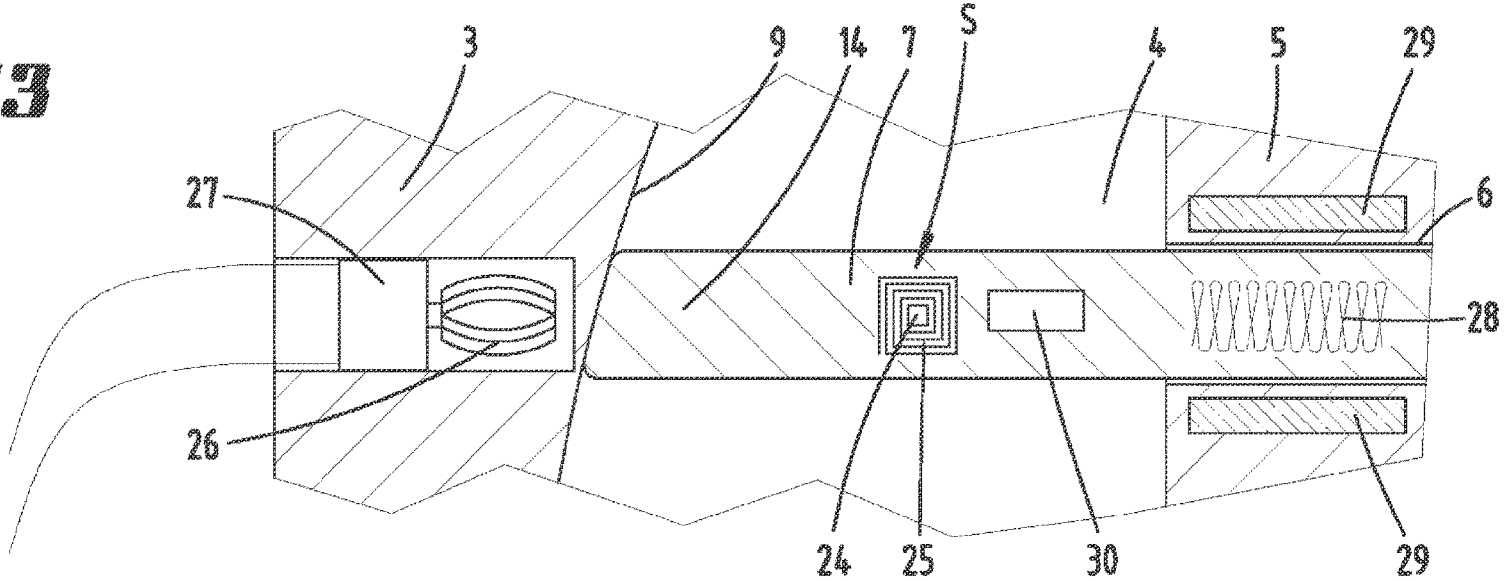
Fig. 13
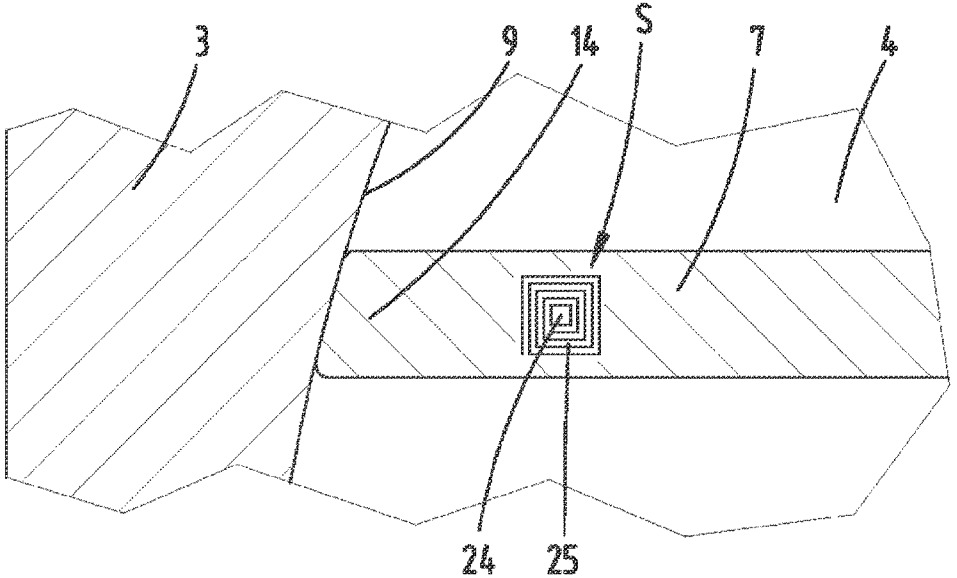
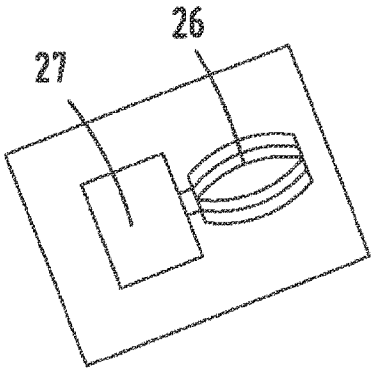
Fig. 14

ROTARY SLIDE ASSEMBLY, AND METHOD FOR MONITORING THE WEAR OF A SLIDE IN A ROTARY SLIDE ASSEMBLY

CROSS REFERENCE TO RELATED APPLICATIONS

This application is the National Stage of PCT/EP2020/068518 filed on Jul. 1, 2020, which claims priority under 35 U.S.C. § 119 of German Application No. 10 2019 118 139.9 filed on Jul. 4, 2019, the disclosure of which is incorporated by reference. The international application under PCT article 21(2) was not published in English.

TECHNICAL FIELD

The invention relates to a method for monitoring the wear of one or more slides in a rotary slide assembly comprising a rotary slide rotor and a slide receiving area for the slide or slides in the rotary slide rotor.

Furthermore, the invention relates to a rotary slide assembly with a rotary slide device comprising a housing, a rotary slide chamber and a rotary slide rotor, wherein slides are arranged radially movably in slide receiving areas in the rotary slide rotor.

PRIOR ART

A rotary slide assembly is known, for example, from DE 103 30 541 A1. In the usual manner, this is a slide vane rotary vacuum pump or a rotary slide compressor with a housing forming a rotary slide chamber. The rotary slide chamber is preferably configured in the form of a cylindrical bore. The rotary slide rotor is usually cylindrical, with slides movably arranged in rotor slots as slide receiving areas. The slots in the rotor can be oriented strictly radially with respect to a cross-section transverse to the axis of rotation of the rotor or can also be oriented at an acute angle to a radial.

During operation of the assembly, the rotary slide rotor rotates radially offset from a central axis of the rotary slide chamber. Thus, this results in closed chambers which are separated by the substantially radially displaceable slides and the size of which changes during one revolution of the rotor. The change in size results in pressure differences between the individual chambers and thus between the inlet side and the outlet side of the pump.

The slides slide with their free edge regions facing the slide chamber wall along the wall during corresponding rotation of the rotor. This results in wear of the slides to the known extent. Exceeding a wear limit of the slides can lead to a loss with respect to the pump output.

In this context, methods are known for monitoring the slides with respect to reaching a wear limit.

Thus, according to U.S. Pat. No. 6,565,337 B2, a view port can be provided through which a slide in the slide receiving area can be visually detected.

Also, according to FR 2985 553 A1, a check of the slide length viewed in the direction of displacement is possible with the aid of a measuring rod. Such a measurement is only possible when the rotary slide assembly is at a standstill.

According to U.S. Pat. No. 6,877,966 B2, for example, the slide can have a limit stop so that, in the event of corresponding wear, the slide no longer comes into full engagement on the wall of the slide chamber over the entire circumference. The resulting loss of negative or positive pressure, and possibly also of output, is used as a measure of wear.

Furthermore, a wear detection system is known from U.S. Pat. No. 3,301,194, in which protruding regions, for example pins, are formed on the slides, which come into engagement when there is corresponding wear and cause a significant noise.

Furthermore, it is known from US 2004/0136 852 A1 that in a rotary slide assembly, a slide actuates a switch arranged in the slide receiving area by means of a projection formed on the slide when a certain wear state is reached.

In DE 40 35 463 A1, a sensor by means of which any jamming of a slide in a slide receiving area is detected is provided in a rotary slide assembly.

SUMMARY OF THE INVENTION

Based on the prior art described above, the invention deals with the object of providing a method for monitoring the wear of one or more slides in a rotary slide assembly which permits advantageous monitoring. Furthermore, it is also an object to provide an advantageous rotary slide assembly with regard to wear monitoring.

This object is achieved with respect to a method for monitoring one or more slides, wherein it is intended that a signal representing a wear state of the slide or slides is continuously generated.

With such a configuration, the wear state can be detected and, if necessary, requested even during operation of the rotary slide assembly. In addition, however, it is also possible to use such an approach for generating or requesting an electric or electronic signal even or only at a standstill of such a rotary slide assembly.

With regard to the rotary slide assembly, a sensor is provided which allows the position of a slide in the slide receiving area to be detected in a certain angular position of the rotary slide rotor or independently thereof, for comparison of the detected value with a set value.

Furthermore, this object is also achieved with an assembly wherein it is intended that the slides are received in slot-shaped slide receiving areas which extend over an entire axial length of the rotor and that a light barrier with a light transmitter and a light receiver is provided, wherein the light barrier is arranged in such a way that prior to reaching a wear limit, the light barrier is interrupted by the slide located in the receptacle and, upon reaching the wear limit, the emitted light beam can reach the light receiver through the resulting free space in the slide receiving area.

Furthermore, the object is also achieved with an assembly having a sensor which consists of a voltage source and a conductor which connects the voltage source in the sense of a short circuit, wherein the electrical conductor acts in a switch-like manner upon reaching the wear limit and the switching state can be detected by means of corresponding evaluation electronics, wherein further the conductor is arranged in the slide and can ultimately be exposed with increasing wear of the slide, wherein at a certain wear state of the slide, the conductor establishes an electrically conductive connection with the voltage source, wherein, further, the ends of a voltage or switching circuit, which are bridged in the wear state by the electrically conductive conductor in a switch-like manner, are exposed in the chamber wall along which the slides slip.

Finally, this object is also achieved with regard to the rotary slide assembly wherein it is intended that the detected value can be determined by a current generated with the aid of a magnet and a coil during one revolution of the rotary slide rotor, wherein accordingly not only the state of reaching the wear limit can be detected but, in addition, the increasing wear of the slide is also made representable in the form of continuously detected values since the current generated by the magnet and the coil increases with increasing wear of the slide and the related increasing proximity of magnet and coil so that the detected current level allows conclusions to be drawn about a current wear state of the slide.

One or more slides themselves or one or more slide receiving areas in their interaction with the one or more slides can be used to generate a requestable electric or electronic signal for detecting a wear state of the slide or slides.

It can be significant with respect to a concrete configuration whether the rotary slide assembly is a dry-running rotary slide assembly or an oil-lubricated rotary slide assembly. In the latter case, it can be useful to avoid an exposed electrical contact or electrical conductor.

It is particularly preferable that the detection of a wear state of the slide or slides can be performed during operation of the rotary slide assembly. In addition, however, a configuration for detecting a wear state of the slide or slides only or even during a standstill of the rotary slide assembly is also possible. In the latter case, however, in particular also to the effect that no disassembly of the rotary slide assembly is required, but the wear state can be detected as far as possible without mechanical intervention in the rotary slide assembly.

It is thus possible in an advantageous manner to generate a signal, if necessary continuously and preferably during operation of the rotary slide assembly, but if necessary also when the rotary slide assembly is at a standstill, which signal reflects the wear state of the slide or slides. The signal can in the first instance be stored and thus be kept ready for a possibly temporally shifted request. However, the signal can also be continuously detected and evaluated by an evaluation unit. The slide or slides can be monitored in such a way that the reaching of a wear limit, at which the slide is preferably to be replaced, can be detected and determined early or immediately. The signal can be generated electrically or electronically.

The signal generation and also signal request can in particular also take place without further mechanical intervention, in particular without disassembly of the rotary slide assembly.

The aforementioned configurations can in the first instance be given for only one slide of a rotary slide assembly. However, they can also be given for multiple slides of a rotary slide assembly and also for all slides of a rotary slide assembly.

For example, the detection of a relative position of the slide in the slide receiving area can be carried out, as is also preferred, in particular during ongoing operation of the pump in a predetermined angular position of the rotor. According to a possible configuration, one, multiple or each slide of the rotor can be detected by sensors in this angular position and the generated value can be evaluated. In addition, however, such detection can also be carried out independently of the angular position and/or the displacement position of the slide relative to the slide receiving area.

In one possible configuration, the slide can be monitored individually and directly, for example by directly detecting when a slide wear limit is reached. Alternatively, or also in combination therewith, the slide receiving area can also be monitored in terms of which position, in particular maximum extended position, the slide assumes or can assume relative to the slide receiving area.

Depending on whether or not the slide wear limit has been reached, but if necessary also in the case of a repetitive measurement at each intermediate value, a signal can be generated directly, which signal can furthermore trigger an action. In another configuration, such a signal can also be generated only upon a corresponding requesting of the slide wear state.

Preferably, no shutdown of the assembly is required for checking the slide wear.

In a further configuration, the value for a relative position of the slide in the slide receiving area can be detected and evaluated by a sensor.

With regard to the sensor, the sensor can be, as is also preferred, an electronic or electric sensor, alternatively a tactile sensor, the signals of which can preferably be evaluated electronically.

According to a refinement, the detected value can be compared with a set value, wherein a signal is triggered upon falling below or also exceeding the set value. The value detected via the sensor can be evaluated directly in the rotary slide assembly. Alternatively, transmitting the detected value to an evaluation or comparison unit can be performed outside the rotary slide assembly, for example by signal transmission, or furthermore by radio, for example. The evaluation and comparison unit can be part of a computer system, if necessary of a system external with respect to the assembly. Alternatively, such an evaluation and comparison unit can also be directly part of the assembly. Also, the value can be detected and subsequently evaluated via such a remote request.

Thus, for example, a corresponding measurement or request of measured values can be carried out from outside with a correspondingly designed measuring instrument, accordingly outside the assembly, at predetermined time intervals or also as required, even during operation of the assembly.

The comparison of the measured value with a predetermined set value, which is preferably carried out immediately in terms of time, can result in triggering a signal, wherein the signal can further trigger an action. Thus, depending on the detection method of the sensor, a visual indicator can be triggered directly at or locally near the rotary slide assembly when the value falls below or exceeds the set value. In its simplest form, such a visual indicator can be a luminous display, for example a red warning light. Also, such a visual indicator can change, for example, with respect to light intensity and/or color, when the value falls below or exceeds the set value, for example from green to red.

Furthermore, alternatively to or also in combination with the aforementioned, such a visual indicator can be displayed in a region remote to the assembly, furthermore also as a visual indicator on a screen, if necessary of the system performing the evaluation and/or the comparison.

The signal can furthermore be used alternatively to or in combination with a visual indicator to generate a warning tone and/or to switch off the rotary slide assembly and/or to send a message, for example a text or voice message.

The value detected via the sensor may be a measure of a distance of the slide detected continuously, i.e., at each revolution or at each xth revolution of the rotary slide rotor. For example, such a detection can be made at each, or each second, or each third to, for example, each fifth or tenth revolution of the rotary slide rotor in a certain angular position.

By continuously detecting a distance dimension, a continuous progress of the slide wear can be detected and, if necessary, also documented. It can thus be foreseeable for the user at an early stage that the slide will reach the predetermined wear limit (reaching the set value).

Alternatively, the detected value can be a continuously detected state of at least two states. Thus, a comparison can be made continuously as to whether the set value has been reached or not. If the set value is reached, a predetermined action can be taken or a signal can be generated.

A sensor can be provided which allows the position of the slide in the slide receiving area to be detected in a specific angular position of the rotary slide rotor. This can be, as is also preferred, an electronic or electric sensor, alternatively a tactile sensor, the signals of which can be evaluated electronically.

The sensor can be a proximity sensor which can preferably be arranged in a rotationally fixed manner in the housing of the rotary slide assembly and can detect the position of a slide. Thus, further preferably, the slide can be detected within the slide receiving area, wherein the proximity sensor can detect, for example, a rotor-side end region of the slide. In particular, the proximity sensor can be associated with a furthest extended position of a slide.

With increasing wear, the rotor-side end of the slide moves successively outward, in particular radially outward. The proximity sensor, for example an inductive distance sensor, can preferably be arranged in such a way that when the wear limit is reached, the slide reaches an extended position in which the slide can no longer be detected by the proximity sensor.

In the slide wear position, the proximity sensor can directly or, according to a corresponding evaluation also indirectly, preferably detect the slide receiving area alone, thus, correspondingly a free space in the receiving area exposed by the radially inner end of the slide in this position.

A transponder can also be used as a sensor. The transponder can be arranged, as is also preferred, in or on the slide. A detected value can thus be determined by a transponder.

For this purpose, both an active and a passive RFID tag can be used as the transponder. The corresponding reader can be arranged directly in the rotary slide assembly, for example in the region of a rotary slide chamber wall or also in the region of the slide receiving area. Alternatively, the reader can also be an external device that is brought to the rotary slide assembly at intervals or as required in order to read the RFID tag data.

Furthermore, each slide provided may have such a transponder. Alternatively, only one slide may be provided in general with such a transponder or a sensor, the detected values of which may allow conclusions to be drawn about the wear state of the other slides as well.

In particular in the case of a reader unit provided fixed to the device, a distance measurement to the RFID tag at the slide can be carried out, if necessary. In this case, when the distance falls below a predetermined minimum distance, a signal is generated that indicates that the wear limit has been reached.

Furthermore, the presence of the transponder or the RFID tag alone can also be used for wear measurement. For example, a passive RFID tag can also be arranged in such a way that it is destroyed upon reaching the wear limit. Accordingly, the transponder can no longer be detected, so that a corresponding signal can be triggered.

In a further configuration, an active RFID tag may also be provided. Such active RFID tags have the advantage of a significantly greater range of up to 100 meters compared with passive RFID tags. This offers the advantage of possible remote maintenance of the wear state.

The energy supply of such an active RFID tag can be achieved by using the piezo effect during operation of the rotary slide assembly. The pressure acting on the slide surface during operation and continuously changing in the course of a revolution can be used to build up a voltage when a piezo electric sensor is arranged.

Alternatively, the movement of the slide relative to the rotary slide chamber wall and/or relative to the rotary slide receiving area can be used to generate electrical energy. Thus, a coil can further be provided in the slide, which coil can generate an induction voltage and a current flow by means of the rotational and/or linear movement of the slide with magnets fixed to the housing, for example, arranged in the rotary slide chamber wall and/or in the slide receiving area.

The slot-shaped slide receiving areas preferably extend along the entire axial length of the rotor. In a further configuration, this configuration can be used to provide a light barrier with a light transmitter and a light receiver, wherein the light barrier, like the proximity sensor described above, can be arranged in such a way that before a wear limit is reached, the light barrier is interrupted by the slide located in the receiving area, and when the wear limit is reached, the emitted light beam can reach the light receiver through the resulting free space in the slide receiving area.

Also, the sensor can consist of a voltage source and a conductor connecting the voltage source in the sense of a short circuit. The electrically conductive conductor preferably acts in a switch-like manner upon reaching the wear limit. The switching state can be detected by appropriate evaluation electronics. An action is preferably triggered by closing the circuit.

Further, the conductor can be arranged in the slide. With increasing wear of the slide, this conductor is ultimately exposed and at a certain wear state of the slide, the conductor establishes an electrically conductive connection with the voltage source. The ends of a voltage or switching circuit, which are bridged in the wear position by the electrically conductive conductor in a switch-like manner, as is also preferred, can be exposed in the chamber wall along which the slides slip.

Furthermore, the detected value can be determined by a current generated with the aid of a magnet and a coil during one revolution of the rotary slide rotor. As a result of such a method, not only the state of reaching the wear limit alone can be detected but, furthermore, the increasing wear of the slide can preferably also be made representable in the form of continuously detected values. The current generated by the magnet and the coil preferably increases with increasing wear of the slide and the related increasing proximity of magnet and coil. The detected current level allows to draw conclusions about a current state of wear of the slide.

In this context, an action can be such that, for example, the detected values are graphically displayed, if necessary in comparison with the set value, wherein upon reaching the wear limit, i.e. upon falling below or exceeding the set value, a further action may be provided, if necessary, such as the generation of a warning tone or the switching off of the assembly.

The coil and magnet can each be fixed to the housing or arranged on the slide, wherein in a preferred configuration, the magnet, in particular a permanent magnet, is formed on the slide or is arranged embedded therein. In such a configuration, the coil can be provided fixed to the housing and associated with the chamber wall.

BRIEF DESCRIPTION OF THE DRAWINGS

Hereinafter, the invention is explained with reference to the accompanying drawing which, however, only represents exemplary embodiments. A part which is explained only with reference to one of the exemplary embodiments and which is not replaced by another part in a further exemplary embodiment due to the special feature highlighted therein is thus also described for this further embodiment as a possible existing part in any case. In the drawing:

FIG. 7 shows the enlargement of the region VII in FIG. 6;

FIG. 13 shows an illustration substantially corresponding to FIG. 10, relating to another embodiment;

FIG. 14 shows, in another embodiment, an illustration according to FIG. 10.

DESCRIPTION OF THE EMBODIMENTS

Figure 1:
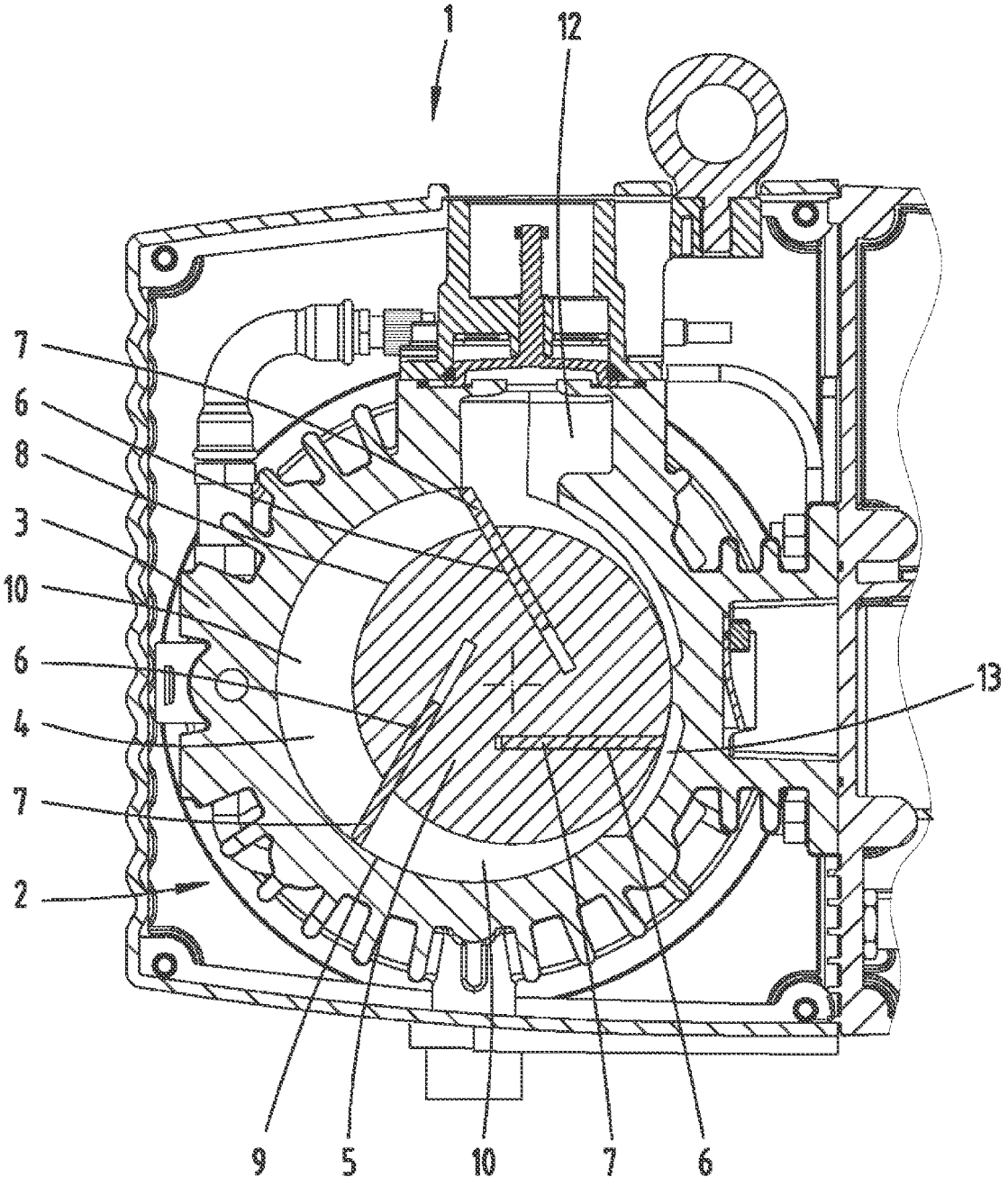
FIG. 1 shows a cross-sectional view of a rotary slide assembly.

Shown and described, in the first instance with reference to FIG. 1, is a rotary slide assembly 1 with a rotary slide device 2, substantially comprising a housing 3 and a rotary slide chamber 4 in which a rotary slide rotor 5 is arranged to be rotatable about a geometric rotor axis x.

The rotary slide rotor 5 has slide receiving areas 6 which are aligned radially or in a secant-like manner with respect to the rotor axis x and are uniformly spaced apart from one another in the circumferential direction of the rotary slide rotor 5, and in which slides 7 are arranged such that they are slidably moveable in the radial or secant direction.

Further, and in addition, a sensor S is provided for detecting the slide position in the slide receiving area 6 in a certain angular position of the rotary slide rotor 5.

The cylindrical rotary slide rotor 5 is arranged eccentrically with respect to the rotary slide chamber 4. Accordingly, the rotor axis x runs parallel but offset to the central axis of the rotary vane chamber 4.

According to the embodiments shown, the rotary slide rotor 5 can have a plurality of slides 7, here for example three, with a corresponding number of slide receiving areas 6. At the edge, the slide receiving areas 6 are open towards the circumferential surface of the rotary slide rotor 5 so that the slides 7 can project substantially radially outwards beyond the circumferential surface 8 of the rotary slide rotor 5.

During operation of the rotary slide assembly 1, the slides 7 can be pressed against the rotary slide chamber wall 9 bounding the rotary slide chamber 4 solely by the rotation of the rotary slide rotor 5 and the resulting centrifugal force.

During operation of the rotary slide assembly 1, the rotary slide rotor 5 rotates radially offset from the center axis of the rotary slide chamber 4, preferably driven by a motor, in particular an electric motor, acting rotationally on the rotor shaft. This results in closed chambers 10, separated by the radially displaceably arranged slides 7, the size of which changes during one revolution of the rotary slide rotor 5.

Figure 2:
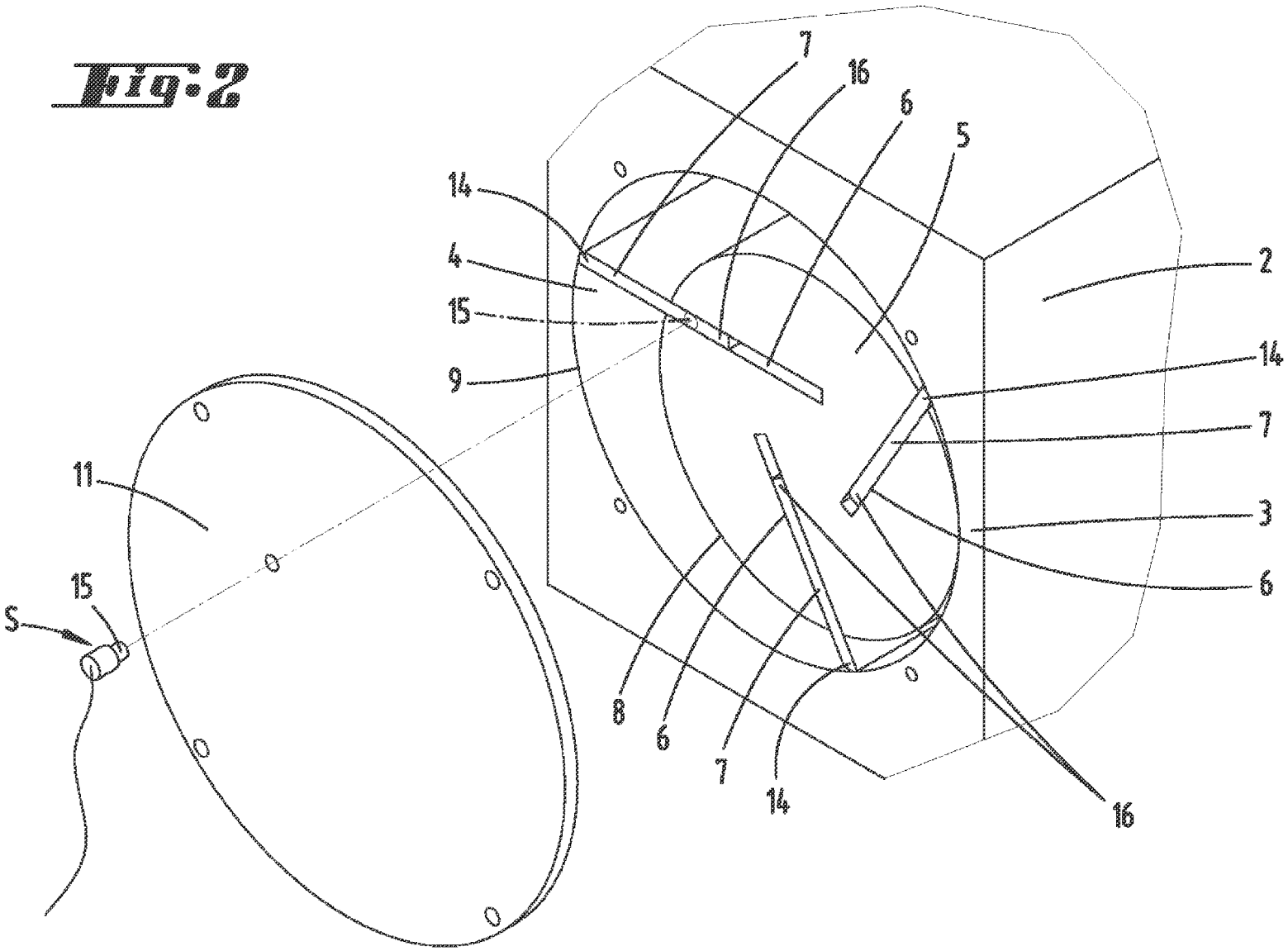
FIG. 2 shows a schematic perspective view of a rotary slide chamber of the rotary slide assembly with a rotary slide rotor and slides received in slide receiving areas, as well as a sensor for detecting the slide position.
Figure 3:
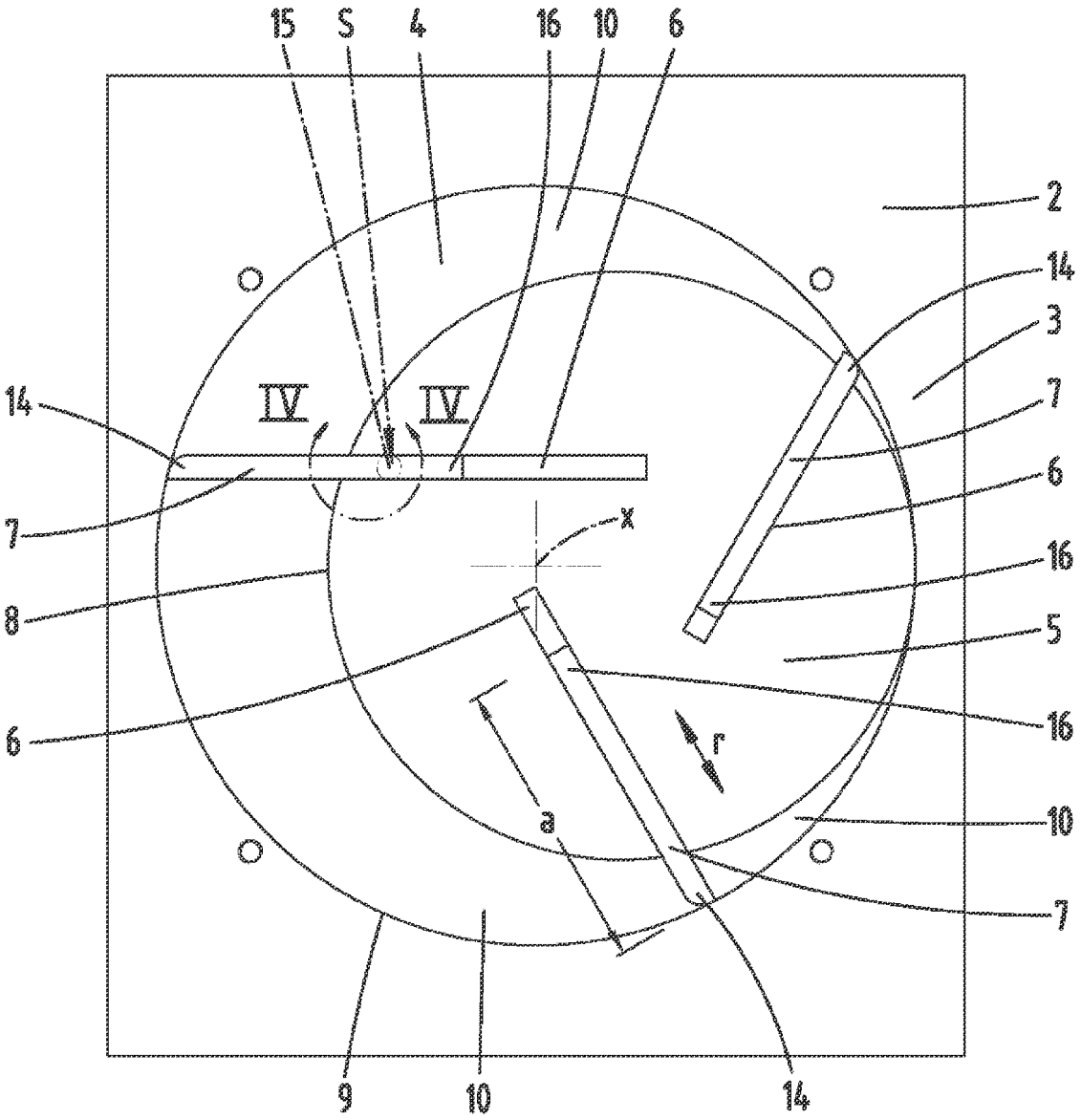
FIG. 3 shows the schematic front view of FIG. 2.
Figure 4:
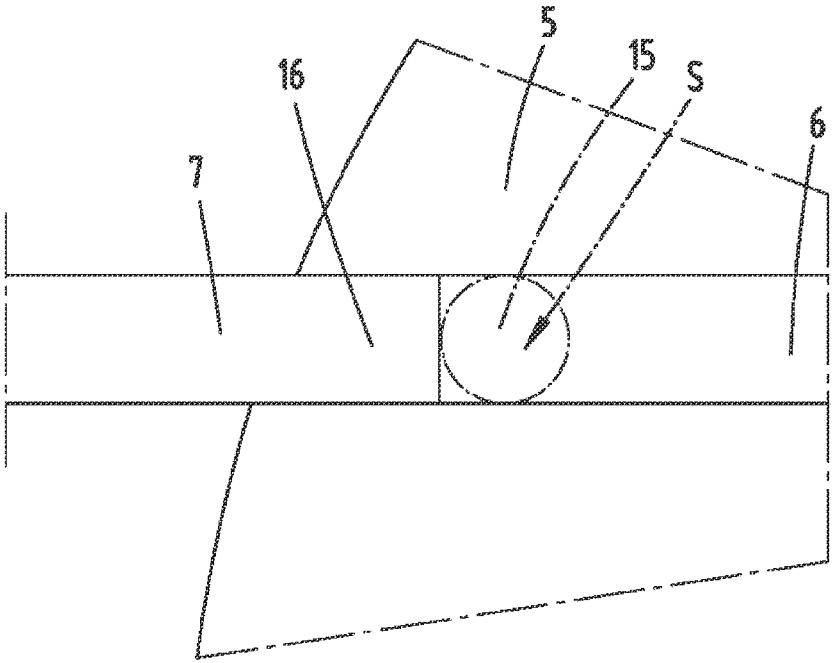
FIG. 4 shows the enlargement of the region IV in FIG. 3.

The rotary slide valve chamber 4 is preferably closed at each end with respect to its longitudinal axis, for example by a rotary slide side cover 11 (see, for example, schematic illustration in FIG. 2).

Via the change in size of the chambers 10 during operation of the rotary slide assembly 1, pressure differences arise between the individual chambers 10 and thus between the inlet side 12 and the outlet side 13 of the blower formed in this manner.

During operation of the rotary slide assembly 1, the slide ends 14 of the slide assembly 7 facing away from the rotary slide rotor 5 slip along the wall 9 of the rotary slide chamber, which leads to successive wear of the slide 7 during operation. Accordingly, due to such wear, the result can be a reduction in the length a of the slides 7 viewed in the direction of displacement r of the slides 7.

Upon reaching a predetermined wear limit, replacing the slide 7 concerned or all slides 7 of the rotary slide rotor 5 is preferably scheduled. Further use of the slides 7 beyond the wear limit can lead to pressure losses, possibly to damage to the rotary slide device 2.

According to the invention, the wear state of the slide 7 is detected during operation of the rotary slide assembly 1, for which purpose the slide 7 itself or the slide receiving area 6 in interaction with the slide 7 is used to generate or request an electrical or electronic signal.

If necessary, a signal can be generated continuously and in any case during the operation of the rotary slide assembly 1, which signal reflects the wear state. In this case, the signal can first be stored and, if necessary, only requested at a later time. Continuous detection and evaluation of the signal is also possible.

Depending on whether or not the slide wear limit has been reached but, if necessary, also in the case of a repetitive measurement at each intermediate value, a signal can be generated immediately, which signal can furthermore trigger an action, such as the generation of an acoustic or visual warning message. Such an action can also be the switching off of the rotary slide assembly 1. Such a signal can also be generated only upon a corresponding request of the slide wear state.

The means for detecting and/or requesting or evaluating can be arranged directly in or on the rotary slide assembly 1. This is particularly suitable for continuous monitoring of the wear limit. Alternatively or also in combination therewith, a means separate from the rotary slide assembly 1 can be provided for detecting and/or requesting and/or evaluating, for example in the form of a portable instrument, which is brought to the rotary slide assembly 1 as required or at predetermined intervals for detecting and/or requesting the signals and evaluation.

To generate such a signal, as is preferred, a sensor S can be provided. This may be an electronic or electric sensor S.

The accompanying drawings show different embodiments and arrangements of such a sensor S. Thus, according to the illustrations in FIGS. 1 to 5, firstly, a sensor S in the form of a proximity sensor 15 is provided. This can be, for example, a capacitive distance sensor.

Such a proximity sensor 15 can be arranged, for example, in a rotary slide side cover 11 (compare, for example, FIG. 2). In this case, the arrangement of the proximity sensor 15 can be selected such, as is also preferred, that in the case of slides 7 which have not reached their wear limit, the sensor detects in the course of one revolution of the rotary slide rotor 5 about the rotor axis x in a predetermined angular position (compare, for example, FIG. 3) the slide 7 extending close to the sensor in this angular position (compare FIG. 4). Accordingly, due to the slide 7 detected in this angular position via the proximity sensor 15, a signal is generated which can be detected or evaluated as a value.

Figure 5:
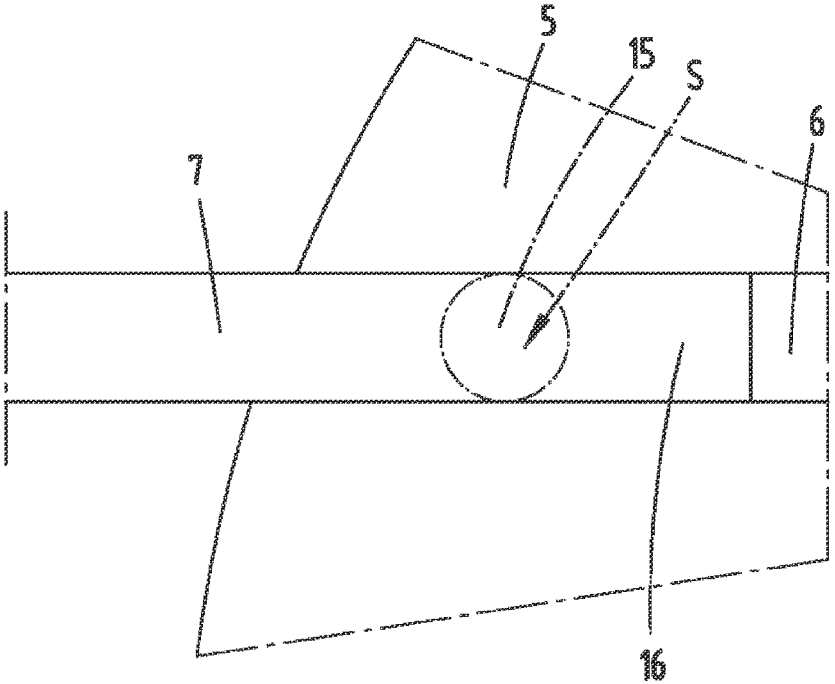
FIG. 5 shows an illustration corresponding to FIG. 4, but relating to a slide wear position detected by sensor.

With increasing wear of the slide 7, the end 16 of the slide 7 facing away from the rotary slide chamber wall 9 and extending inside the slide receiving area 6 moves increasingly further radially outward and finally leaves the region detected by the proximity sensor 15 according to the illustration in FIG. 5. Now, the proximity sensor 15 does not detect the slide 7 in the relevant angular position in question of the rotary slide rotor 5, but rather the slide receiving area 6 exposed behind the slide end 16.

The signal generated in this way or the signal not generated in this way can be detected and evaluated as a value which allows conclusions to be drawn about the slide 7 reaching its wear limit.

Detecting the value via the proximity sensor 15 can take place in a clocked manner, for example, according to the illustrated exemplary embodiment, in full rotation of the rotary slide rotor 5 three times at regular intervals from one another, so that all slides 7 (in an arrangement of three slides 7 according to the exemplary embodiment) can be detected by the sensor system.

Also, a sensory detection can only take place at each xth revolution of the rotary slide rotor 5, for example at each second, third, fifth or even tenth revolution.

As a result of the arrangement of the sensor S, continuous monitoring of the slide states is made possible.

With an arrangement of such a proximity sensor 15, the detected value can be a detected state of two states: slide detected—slide not detected.

In an evaluation unit, the detected value can be compared with a set value. The set value in the case of a sensor system using, for example, such a proximity sensor 15 can be "slide detected", so that preferably no further action or measure is triggered in the case of a determined value "slide detected". If necessary, in the event of a deviation from the set value, corresponding information can also be provided in the form of a light display and/or a graphic display which indicates the correct state with respect to wear of the slide 7 or slides 7.

Deviation from the set value, for example the value "slide not detected", can further trigger an action, for example in the form of an illuminated display, for example lighting up a red warning lamp, generating a text message on a screen and/or emitting a warning tone and/or further, for example, switching off the rotary slide assembly 1.

Alternatively to an arrangement of a proximity sensor 15, a light barrier can also be used, for example. Such a sensor S would also be arranged fixed to the housing, for example with a light transmitter in the region of the one rotary slide side cover 11 and a light receiver in the region of the opposite side cover 11. The light beam is to be aligned in such a way that in a slide position which corresponds to the position when the wear limit is reached, the light beam can be freely directed through the slide receiving area 6 and can be received by the opposite receiver. A "light received" value detected in this manner can then be interpreted as the slide reaching the wear position. Before reaching the wear position, the emitted light beam does not reach the receiver due to the slide 7 being positioned in the light path.

Figure 6:
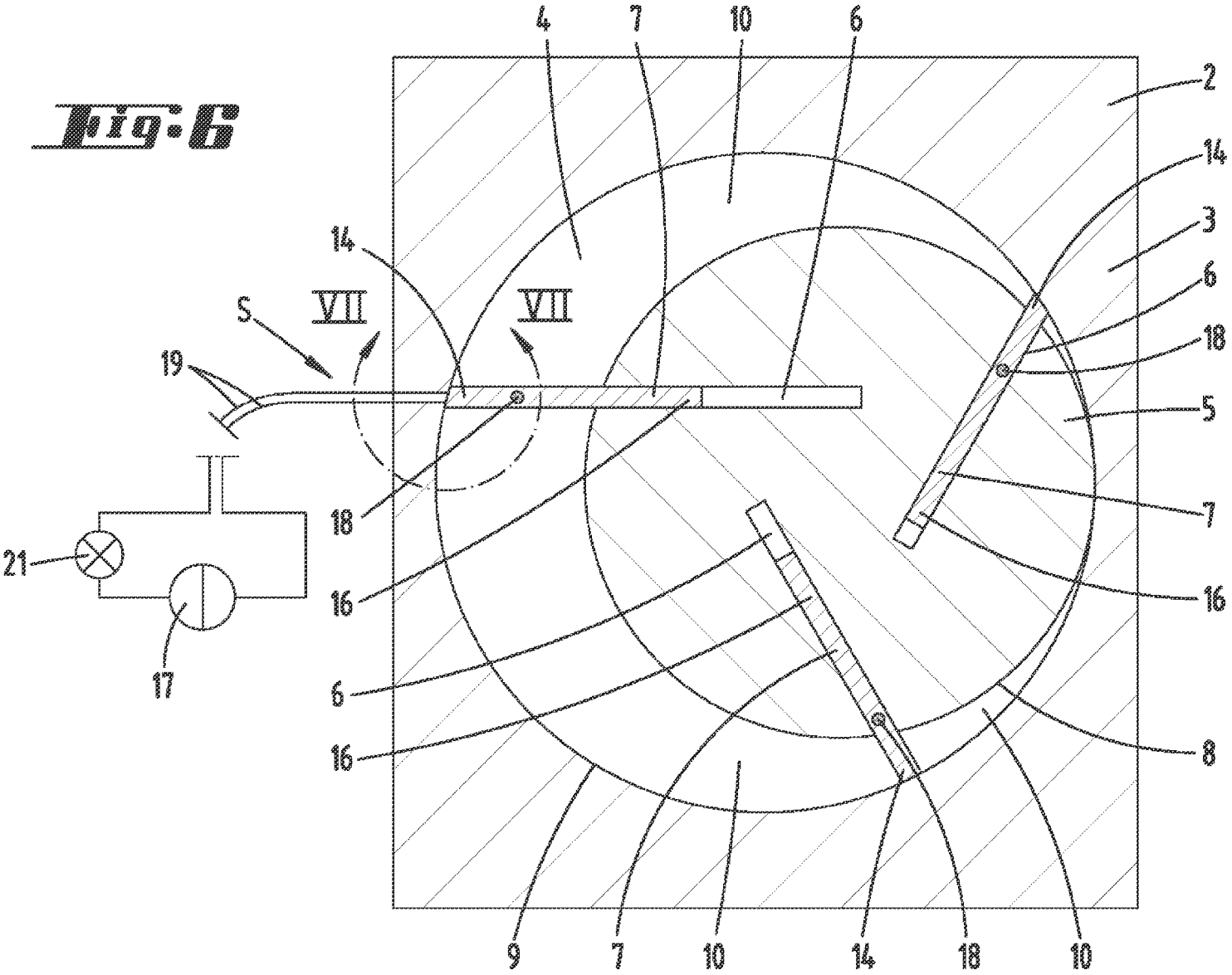
FIG. 6 shows a schematic cross-sectional view through the rotary slide chamber with rotary slide rotor and slides, relating to a second embodiment with regard to the arrangement and design of the sensor system.
Figure 1:
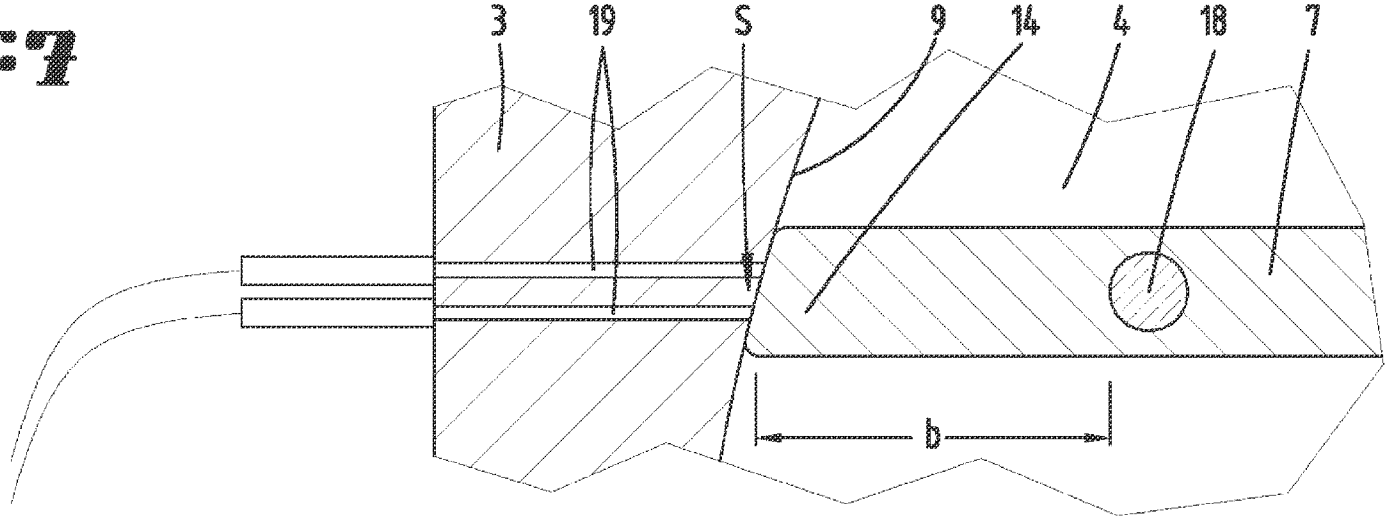
Figure 8:
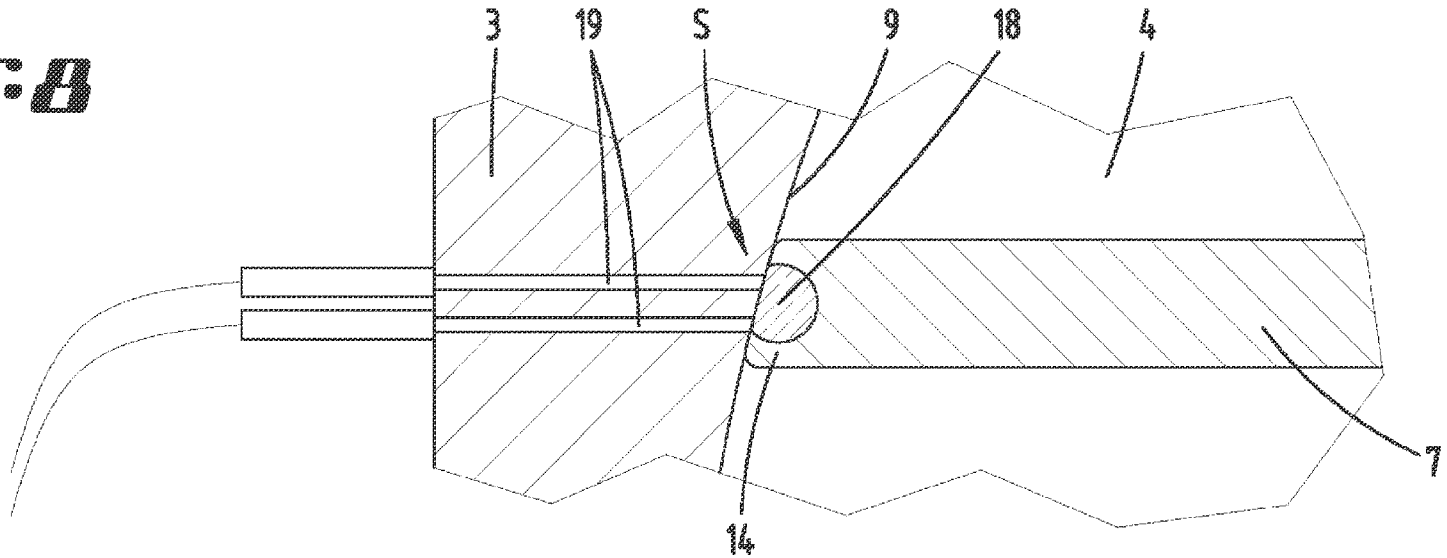
FIG. 8 shows an illustration corresponding to FIG. 7, but relating to a slide wear position detected by sensor.

Also, according to the further illustrations in FIGS. 6 to 8, the sensor S can substantially consist of a voltage source 17 and a conductor 18.

As is also preferred, the electrically conductive conductor 18, for example in the form of a copper insert, can be arranged in the slide 7, if necessary completely embedded therein.

The conductor 18 is further preferably initially spaced apart from the free slider end 14 in the direction of displacement r.

Furthermore, the slide 7 as such can be made of a non-electrically conductive material.

The voltage source 17 can be provided in the rotary slide assembly 1 or associated therewith. The lines 19 and 20 are led from the voltage source 17 to the rotary slide chamber wall 9 and, further, can be provided there electrically insulated in the wall 9 in such a way that they are exposed towards the rotary slide chamber 4 in a sliding-contact manner and are spaced apart from one another (compare also FIG. 7).

With increasing wear of the slide 7, the distance b between the electrically conductive conductor 18 of the slide and the rotary slide chamber wall 9 decreases. The conductor 18 thereby preferably marks the wear limit of the slide 7.

Starting from the slide end 14, the distance b decreases with increasing wear and abrasion of the slide 7 up to a position according to FIG. 8 in which the conductor 18 is exposed due to the wear and abrasion and accordingly connects the conductors 19 and 20 in the sense of a short circuit in the course of the rotor rotation in an angular position.

A signal generated by this can be evaluated as a corresponding value of reaching the wear limit, which can trigger a corresponding action as described above. The illustration in the drawing schematically shows a light 21, which lights up in the short-circuit position according to FIG. 8 as a result of closing the circuit.

By means of the above-described embodiments, a possibly abrupt change of states is preferably detected. This is shown schematically in the diagram according to FIG. 9, in which the time t is plotted on the abscissa and the magnitude of the value W is plotted on the ordinate.

It can be seen that upon reaching the wear limit at time t', the detected value $W_{ACTUAL}$ increases abruptly and reaches or exceeds the specified set value $W_{SET}$. From this, a signal is generated at time t', which preferably leads to the triggering of an action.

The ends of the conductors 19 and 20 leading freely relative to the rotary slide chamber 4 into the rotary slide chamber wall 9 as well as the conductor 18 provided in the slide 7 act in the manner of a switch upon reaching the slide wear limit.

In the circumferential direction, but if necessary also as viewed in the direction of axis extent, a plurality of sensors S configured in such a manner can be provided in the rotary slide chamber wall 9.

Figure 10:
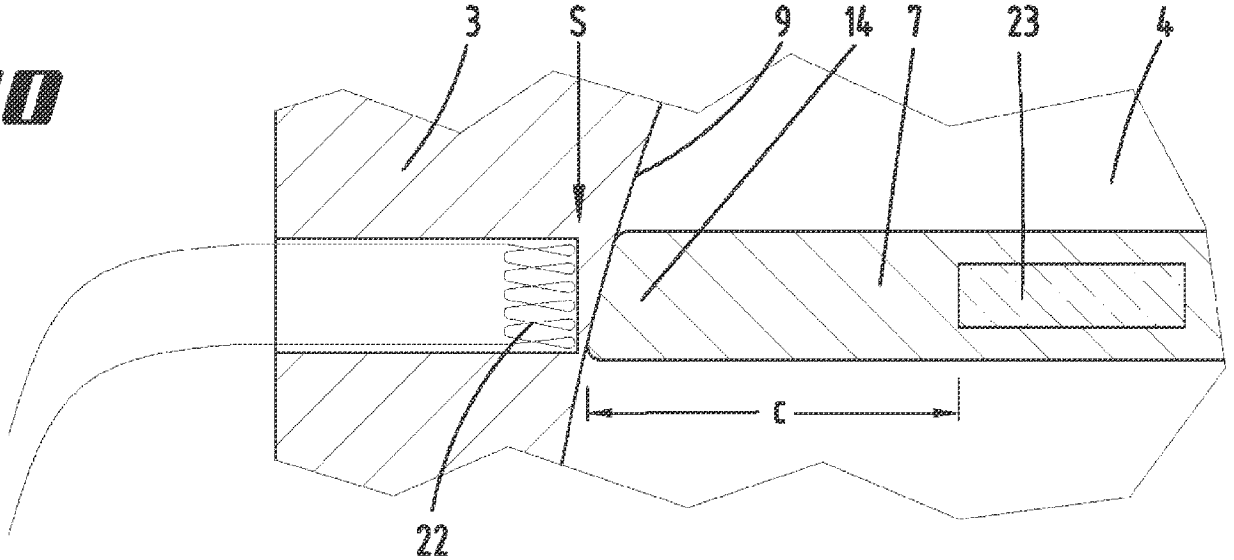
FIG. 10 shows an enlarged detailed sectional view according to FIG. 7, but relating to a third embodiment.
Figure 11:
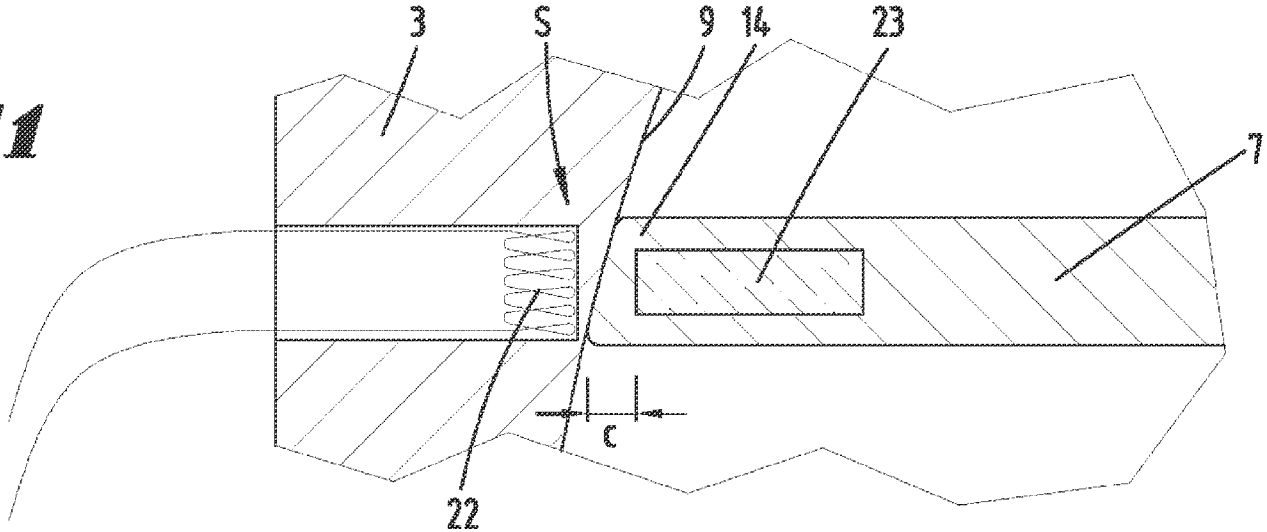
FIG. 11 shows an illustration corresponding to FIG. 10, but relating to a slide wear position.

Moreover, this can also be the case in the schematic embodiment further shown in FIGS. 10 and 11, in which a distance dimension c is continuously monitored to monitor the slide wear limit.

Such a sensor S can consist of a coil 22 fixed to the housing and a magnet 23, in particular a permanent magnet, formed on or in the slide 7.

The magnet 23, like the previously described electrically conductive conductor 18, can be incorporated in the slide 7 or arranged accommodated therein, preferably at a distance c from the slide end 14 cooperating with the rotary slide chamber wall 9.

The coil 22 in the housing 3 is associated with the rotary slide chamber wall 9 in such a way that in a certain angular position of the rotary slide rotor 5, the magnet 23 can reach an inductive associated position with respect to the coil 22.

Via the interaction of magnet 23 and coil 22, a current is induced in the coil and an electric voltage is generated each time the slide 7 passes the coil 22. With increasing wear of the slide 7 and related decrease of the distance c between the magnet 23 and the coil 22, the value of the induced electric current and/or voltage increases.

The current and/or voltage values can be continuously detected and, if necessary, recorded. From this, the increasing wear of the slide 7 can be logged. A predictive wear detection is thus made possible.

Figure 9:
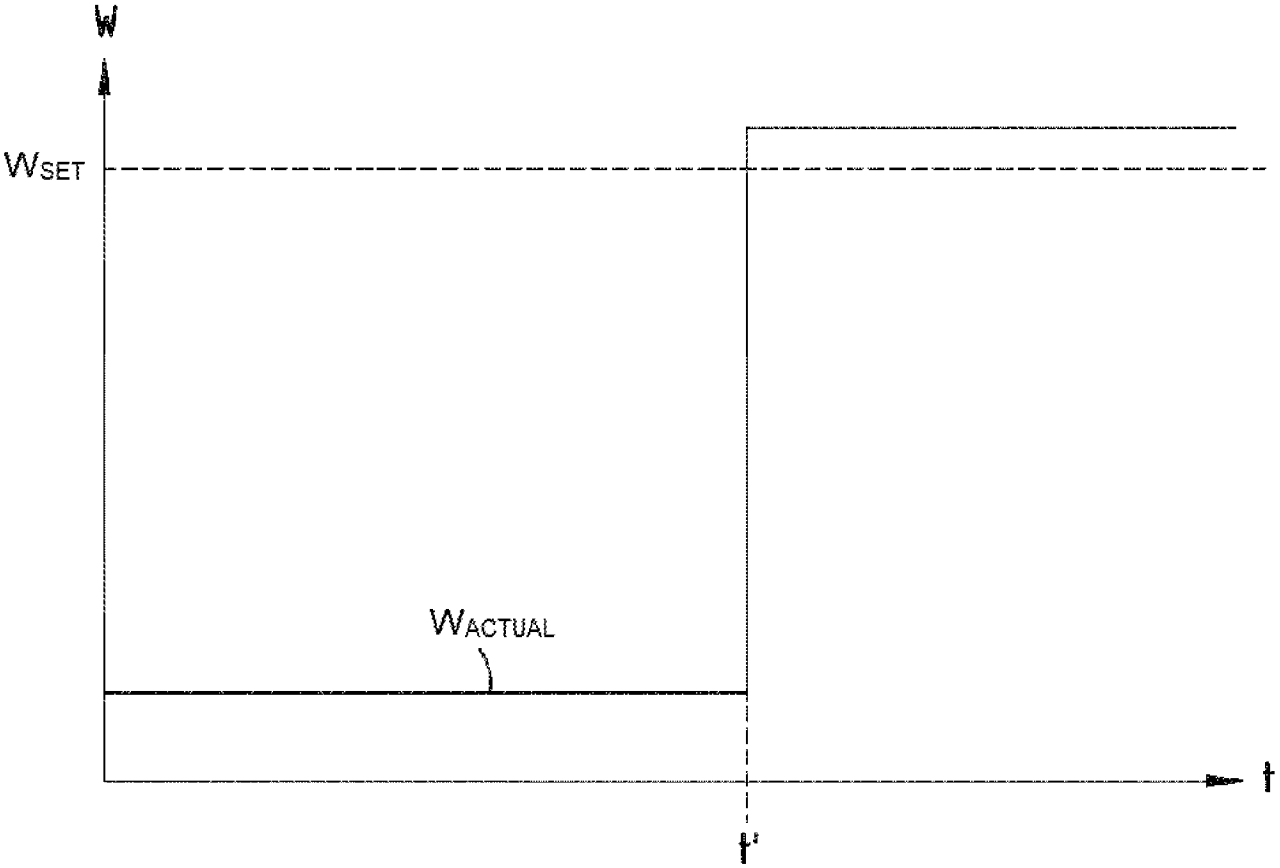
FIG. 9 shows a diagram illustrating the detected sensor values compared with a set value.
Figure 12:
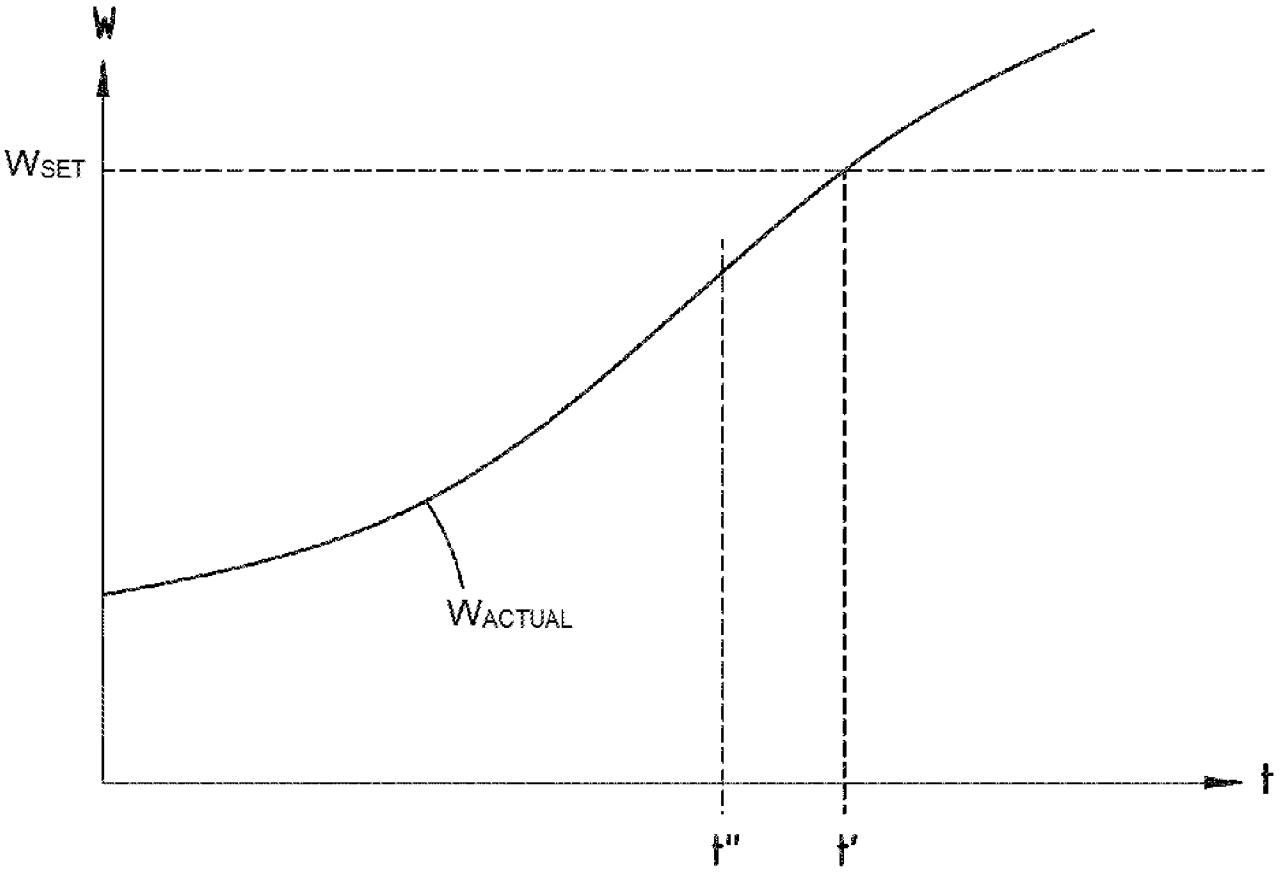
FIG. 12 shows a diagram according to FIG. 9, relating to the embodiment according to FIGS. 10 and 11.

FIG. 12 shows a diagram in this respect corresponding to the diagram in FIG. 9. In this embodiment, the continuously determined value $W_{ACTUAL}$ preferably increases steadily, if necessary linearly, and reaches the set value $W_{SET}$ at time t'. Such a detection can also be used for early warning, so that a pre-signal can be generated, for example, at time t", thus before the wear limit of slide 7 is reached.

Figure 15:
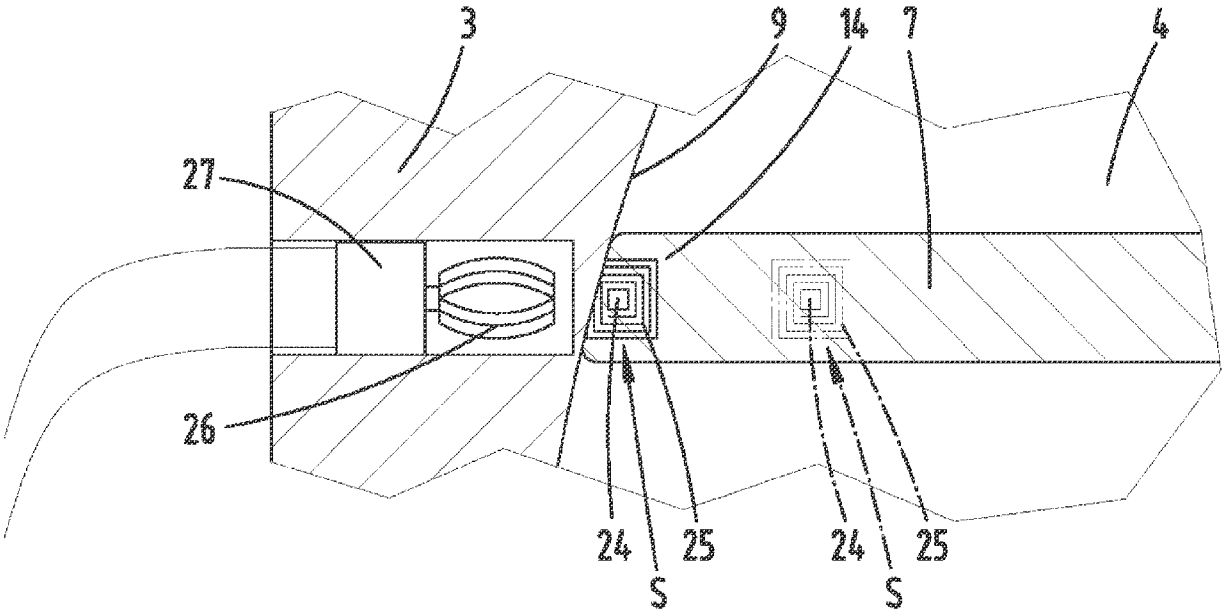
FIG. 15 shows a further illustration corresponding to FIG. 10, relating to an alternative embodiment.

The illustrations in FIGS. 13 to 15 show the arrangement of a sensor S in the slide 7 in the form of a transponder, further in particular in the form of an RFID tag 24. The RFID tag 24 is provided in a conventional manner with an antenna 25 to enable data in the RFID tag 24 to be read out via a reading unit 26. This reading unit 26 also has an antenna 27.

According to the schematic illustration in FIG. 13, the reading unit 26 can be arranged in the housing 3 of the rotary slide device 2, further, in particular close to the rotary slide chamber wall 9. Accordingly, the RFID tag 24 can be read or the shortest distance to the RFID tag 24 can be determined each time the slide 7 passes the reading unit 26.

The RFID tag can be a passive RFID tag 24, as shown by way of example in FIG. 15, or an active RFID tag 24 (compare FIGS. 13 and 14).

An inductive power supply can be provided to supply power to an active RFID tag 24. For example, a coil 28 can further be provided in the slide 7, which coil interacts with magnets 29 fixed relative to the slide 7 to generate an inductive voltage. These magnets 29 can further be provided, for example, in the slide receiving area 6, wherein further the coil 28 is preferably positioned in the region of the slide's 7 end at the receiving area. Due to the oscillating linear movement of the slide 7 relative to the slide receiving area 6 during operation of the rotary slide assembly 1, a voltage can be induced by the coil/magnet arrangement to supply the RFID tag 24 at the slide.

Accordingly, the RFID tag 24 according to this embodiment is supplied with power only during operation of the rotary slide device 2. In order to provide a readout of the RFID tag 24 even when the device is not in operation, an energy storage device 30 can be provided in the slide 7.

In particular in the case of an active RFID tag 24, the reading unit 26 can also be designed as a device separate from the rotary slide assembly 1, which can be brought close to the rotary slide assembly 1 for the purpose of requesting the sensor data. Due to the relatively high range of active RFID tags 24, remote monitoring of slide wear can thus also be achieved.

REFERENCE LIST

1 rotary slide assembly
2 rotary slide device
3 housing
4 rotary slide chamber
5 rotary slide rotor
6 slide receiving area
7 slide
8 circumferential surface
9 rotary slide chamber wall
10 chamber
11 rotary slide side cover
12 inlet side
13 outlet side
14 slide end
15 proximity sensor
16 slide end
17 voltage source
18 conductor
19 line
20 line
21 light
22 coil
23 magnet
24 RFID tag
25 antenna
26 reading unit
27 antenna
28 coil
29 magnet
30 energy storage
S sensor
W value
$W_{ACTUAL}$ determined value
$W_{SET}$ set value
a length
b distance
c distance dimension
r direction of displacement
t time
t' time
t" time
x rotor axis

The invention claimed is:

1. A method for monitoring the wear of one or more slides (7) in a rotary slide assembly (1), comprising a rotary slide rotor (5) and one or more slide receiving areas (6) for the slide or slides (7) in the rotary slide rotor (5), comprising the step of detecting a wear state of the one or more slides (7), by generating an electric or electronic signal or by a request of an electric or electronic signal by the slide or slides (7) themselves or the one or more associated slide receiving areas (6) in their interaction with the slide or slides (7), wherein the signal is continuously generated and reflects a wear state of the slide (7) or slides and wherein the signal is generated by a proximity sensor configured for detecting a determined angular position of the slide or for detecting the slide receiving area exposed behind an end of the slide, or wherein the sensor is a transponder or a tactile sensor, the signals of which are evaluated electronically.

2. The method according to claim 1, wherein a value ($W_{ACTUAL}$) for a relative position of the slide (7) in the slide receiving area (6) is detected and evaluated by the sensor at a standstill of the rotary slide assembly or continuously during operation of the rotary slide assembly (1).

3. The method according to claim 2, wherein the detected value ($W_{ACTUAL}$) is compared with a set value ($W_{SET}$) and an action is triggered upon falling below or exceeding the set value ($W_{SET}$).

4. The method according to claim 3, wherein the action is generating a warning tone and/or switching off the rotary slide assembly (1) and/or sending a message.

5. The method according to claim 2, wherein the detected value ($W_{ACTUAL}$) is a state of two states that is detected at each revolution or at each xth revolution of the rotary slide rotor (5).

6. A method for monitoring the wear of one or more slides (7) in a rotary slide assembly (1), comprising a rotary slide rotor (5) and one or more slide receiving areas (6) for the slide or slides (7) in the rotary slide rotor (5), comprising the step of detecting a wear state of the one or more slides (7), by generating an electric or electronic signal or by a request of an electric or electronic signal by the slide or slides (7) themselves or the one or more associated slide receiving areas (6) in their interaction with the slide or slides (7), wherein the signal is continuously generated and reflects a wear state of the slide (7) or slide(s), wherein a value ($W_{ACTUAL}$) for a relative position of the slide (7) in the slide receiving area (6) is detected and evaluated by a sensor (S) at a standstill of the rotary slide assembly or continuously during operation of the rotary slide assembly (1), wherein the detected value ($W_{ACTUAL}$) is a distance measure (c) detected at each revolution or at each xth revolution of the rotary slide rotor (5).

7. A method for monitoring the wear of one or more slides (7) in a rotary slide assembly (1), comprising a rotary slide rotor (5) and one or more slide receiving areas (6) for the slide or slides (7) in the rotary slide rotor (5), comprising the step of detecting a wear state of the one or more slides (7), by generating an electric or electronic signal or by a request of an electric or electronic signal by the slide or slides (7) themselves or the one or more associated slide receiving areas (6) in their interaction with the slide or slides (7), wherein the signal is continuously generated and reflects a wear state of the slide (7) or slide(s), wherein a value ($W_{ACTUAL}$) for a relative position of the slide (7) in the slide receiving area (6) is detected and evaluated by a sensor (S) at a standstill of the rotary slide assembly or continuously during operation of the rotary slide assembly (1), wherein the detected value ($W_{ACTUAL}$) is determined by a transponder.

8. The method according to claim 7, wherein the detected value ($W_{ACTUAL}$) is determined by a transponder based on RFID.

9. A rotary slide assembly (1) with a rotary slide device (2) comprising a housing (3), a rotary slide chamber (4) and a rotary slide rotor (5), wherein slides (7) are arranged radially movably in slide receiving areas (6) in the rotary slide rotor (5), wherein one or more of the slides (7) themselves or one or more of the slide receiving areas (6) in their interaction with the slide or slides (7) are configured to generate a requestable electric or electronic signal for detecting a wear state of the slide or slides (7), wherein detection of the wear state is performed when the rotary slide assembly (1) is at a standstill and/or during operation of the rotary slide assembly (1), wherein a sensor (S) is provided which allows the position of a slide (7) in the slide receiving area (6) to be detected in a certain angular position of the rotary slide rotor (5) or independently thereof, for comparison of the detected value (W) with a set value ($W_{SET}$), Wherein the Sensor (S) is a Proximity Sensor (15), a Transponder or a Tactile sensor, the signals of which are evaluated electronically.

10. The rotary slide assembly according to claim 9, wherein the value detected via the sensor is a continuously detected measure of a distance of the slide (7), which is detected at each revolution or at each xth revolution of the rotary slide rotor (5), or is a continuously detected state of at least two states, so that a comparison is continuously made as to whether the set value ($W_{SET}$) is reached or not.

11. A rotary slide assembly (1) with a rotary slide device (2) comprising a housing (3), a rotary slide chamber (4) and a rotary slide rotor (5), wherein slides (7) are arranged radially movably in slide receiving areas (6) in the rotary slide rotor (5), wherein one or more of the slide receiving areas (6) in their interaction with the slide or slides (7) are configured to be used to generate a requestable electric or electronic signal for detecting a wear state of the slide or slides (7), wherein, the detection of the wear state is performed when the rotary slide assembly (1) is at a standstill and/or during operation of the rotary slide assembly (1), wherein the slides (7) are received in the slide receiving areas (6) which extend over an entire axial length of the rotor, and further comprising a light barrier having a light transmitter and a light receiver, wherein the light barrier is arranged in such a way that prior to reaching a wear limit, the light barrier is interrupted by the slide (7) located in the receiving area, and upon reaching the wear limit, the emitted light beam can reach the light receiver through the resulting free space in the slide receiving area (6).

12. A rotary slide assembly (1) with a rotary slide device (2) comprising a housing (3), a rotary slide chamber (4) and a rotary slide rotor (5), wherein slides (7) are arranged radially movably in slide receiving areas (6) in the rotary slide rotor (5), wherein one or more of the slides (7) themselves or one or more of the slide receiving areas (6) in their interaction with the slide or slides (7) are used to generate a requestable electric or electronic signal for detecting a wear state of the slide or slides (7), wherein detection of the wear state is performed when the rotary slide assembly (1) is at a standstill and/or during operation of the rotary slide assembly (1), further comprising a sensor (S) which consists of a voltage source (17) and a conductor (18) which connects the voltage source (17) in the sense of a short circuit, wherein the electrical conductor acts in a switch-like manner upon reaching a wear limit, and the switching state is detected via corresponding evaluation electronics, wherein, further, the conductor is arranged in the slide (7) and is ultimately exposed with increasing wear of the slide (7), wherein at a certain wear state of the slide (7), the conductor (18) establishes an electrically conductive connection with the voltage source (17), wherein ends of a voltage or switching circuit, which are bridged in the closed position by the electrically conductive conductor in a switch-like manner, are exposed in the chamber wall along which the slides slip.

13. A rotary slide assembly (1) with a rotary slide device (2) comprising a housing (3), a rotary slide chamber (4) and a rotary slide rotor (5), wherein slides (7) are arranged radially movably in slide receiving areas (6) in the rotary slide rotor (5), wherein one or more of the slides (7) themselves or the one or more receiving areas (6) in their interaction with the slide or slides (7) are used to generate a requestable electric or electronic signal for detecting a wear state of the slide or slides (7), wherein detection of the wear state is performed when the rotary slide assembly (1) is at a standstill and/or during operation of the rotary slide assembly (1), wherein a detected value (W) is determined by a current generated by a magnet and a coil during one revolution of the rotary slide rotor, wherein the assembly is configured to detect not only a state of reaching the wear limit but, also increasing wear of the slide (7) in the form of continuously detected values since the current generated by the magnet (23) and the coil (22) increases with increasing wear of the slide (7) and the related increasing proximity of the magnet (23) and coil (22), so that a detected current level indicates a current wear state of the slide (7).

* * * * *